United States Patent [19]

Cwalinski et al.

[11] Patent Number: 5,055,080

[45] Date of Patent: Oct. 8, 1991

[54] FLYING DISC WITH DEPENDING FLEXIBLE STRIPS

[76] Inventors: Alexander J. Cwalinski, 71 Rutland St., Boston, Mass. 02118; Brian M. Walsh, 56 Pleasant St., Milton, Mass. 02186

[21] Appl. No.: 679,759

[22] Filed: Apr. 3, 1991

[51] Int. Cl.[5] ..... A63H 27/00

[52] U.S. Cl. ..... 446/46

[58] Field of Search ..... 446/46–48, 446/34; 273/424, 425, 428

[56] References Cited

U.S. PATENT DOCUMENTS 4,294,447 10/1981 Clark ..... 273/428 X 4,846,749 7/1989 Petko ..... 446/46 X

FOREIGN PATENT DOCUMENTS 513863 6/1955 Canada ..... 446/46

*Primary Examiner*—Mickey Yu

*Attorney, Agent, or Firm*—Iandiorio & Dingman

[57] ABSTRACT

A stabilized flying disc comprising a disc, having a convex upper surface, a substantially flat central portion, a downwardly-curving rim, and a concave inner surface and having an attachment member, rotatably connected to the disc proximate the center of the concave inner surface and a plurality of flexible strips secured to the attachment member.

13 Claims, 1 Drawing Sheet

FLYING DISC WITH DEPENDING FLEXIBLE STRIPS

FIELD OF INVENTION

This invention relates to a flying disc toy which incorporates depending flexible strips to provide for ease of catching and increased flying stability.

BACKGROUND OF INVENTION

The present invention relates to recreational flying devices, and more particularly to an improved version of the widely-used inverted flying disc which is usually manually propelled with a spinning motion towards an intended recipient.

Various modifications to the basic flying disc have been made in the past for the purposes of changing flight characteristics or stability to provide for ease of catching. U.S. Pat. No. 4,288,942 issued to Nicholl discloses a flying disc in which the concave underside incorporates spiral vanes to provide improved stability and hovering. U.S. Pat. No. 3,855,728 issued to Hynds discloses a pair of nested discs which separate upon being airborne. U.S. Pat. No. 4,182,073 issued to Tabet discloses a pair of spaced, but rigidly joined, discs for which increased flight stability is claimed. U.S. Pat. No. 4,752,267 issued to Layman also discloses a pair of discs, joined by a telescoping device, for which increased flight stability is also claimed, but without the disadvantage of the fixed disc pair of Tabet. U.S. Pat. No. 4,516,946 issued to Rodarte discloses a flying disc having a freely-rotatable circular flared member on its concave underside so as to allow the disc to continue spinning after being caught. And one U.S. Pat. No. 4,209,936 issued to Sklar, discloses a flying disc with a flexible tail pivotably attached to the disc top surface and used as an indicator of wind direction and velocity. None of the described devices, however, appear to have achieved both improved stability and ease of catching. Additionally, none show a removable feature which would allow a stabilizing element to be replaced or changed.

SUMMARY OF INVENTION

It is therefore an object of this invention to provide a flying disc which, when used as an aerodynamic flying toy, is easy to catch.

It is a further object of this invention to provide a flying disc which flies horizontally even when initially propelled at an angle to the horizontal.

It is a further object of this invention to provide a device which produces a unique visual effect when thrown.

It is a further object of this invention to provide a flying disc which, when used as an aerodynamic flying toy, imparts less of an impact force to a catching party.

It is a further object of this invention to provide a flying disc in which the stabilizing elements are removable and interchangeable.

The invention results from the realization that a truly effective stabilized flying disc can be realized by the attachment of a plurality of depending flexible strips. The act of catching, which benefits from the improved stability, is also made easier with the trailing strips by which the flying disc may also be grasped.

This invention features a stabilized flying disc including a disc with a convex upper surface, a substantially flat central portion, a downwardly-curving rim, and a concave inner surface. Rotatably attached near the center of the inner surface is an attachment member to which is secured a plurality of flexible strips.

In a preferred embodiment, the attachment member may be disc-shaped and positioned at or above the disc rim. The attachment member may be removably secured and may include circumferential slots on its periphery as guide means to position the flexible strips. The flexible strips may be removably secured and may be equally spaced on the attachment member periphery. The space between the attachment member and the disc rim may accommodate a user's fingers. The disc may be about twice the diameter of the attachment member, and the length of each flexible strip may be 24 times its width. Preferably, the strips are approximately 1 inch by 24 inches.

DISCLOSURE OF PREFERRED EMBODIMENT

Other objects, features and advantages will occur to those skilled in the art from the following description of preferred embodiments and the accompanying drawings, in which.

Figure 1:
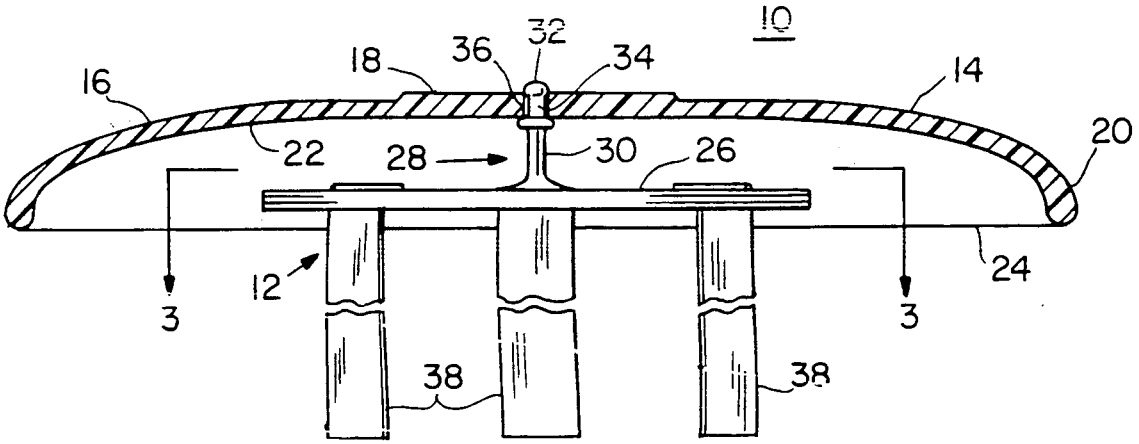
FIG. 1 is a cross-sectional view of a stabilized flying disc having an attachment member according to this invention.

There is shown in FIG. 1 a flying disc 10, according to this invention, consisting of stabilizer 12 and disc 14, having a convex upper surface 16, with a substantially flat central portion 18 and with downwardly-curving rim 20 and a concave inner surface 22. When the device is used as an aerodynamic flying toy, there is generally a space 24 provided to accommodate a user's fingers, thumb, or other throwing device. Stabilizer 12 includes an attachment member 26 and a linkage 28 by means of which attachment member 26 is rotatably secured to disc 14. In the embodiment of FIG. 1, attachment member 26 is an essentially flat disc and linkage 28 includes short rod 30 fixed to attachment member 26. The length of rod 30 is such that attachment member 26 is positioned at or above the rim of disc 14. Enlarged free end 32 of rod 30 includes a necked-down region 34 which allows stabilizer 12 to rotate about the point of attachment 36 while remaining secured to disc 14. Stabilizer 12 also includes a plurality of flexible strips 38, each of which has one end secured to attachment member 26. Securing may be accomplished by either a permanent or a removable method. Flexible strips 38 are spaced along the periphery of attachment member 26 so as to minimize strip entanglement while disc 10 is in flight.

Figure 2:
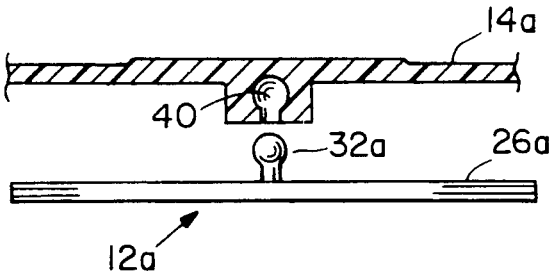
FIG. 2 is a side view of an alternate configuration of an attachment member according to this invention.

In an alternate embodiment, FIG. 2, enlarged free end **32*a* of stabilizer 12*a* is rotatably received in a boss 40 of disc 14*a*. The height of boss 40 is such that attachment member 26*a* is positioned at or above the rim of disc 14*a*. It should be noted that either embodiment described may also allow the removal of stabilizer 12 from disc 14**.

Figure 3:
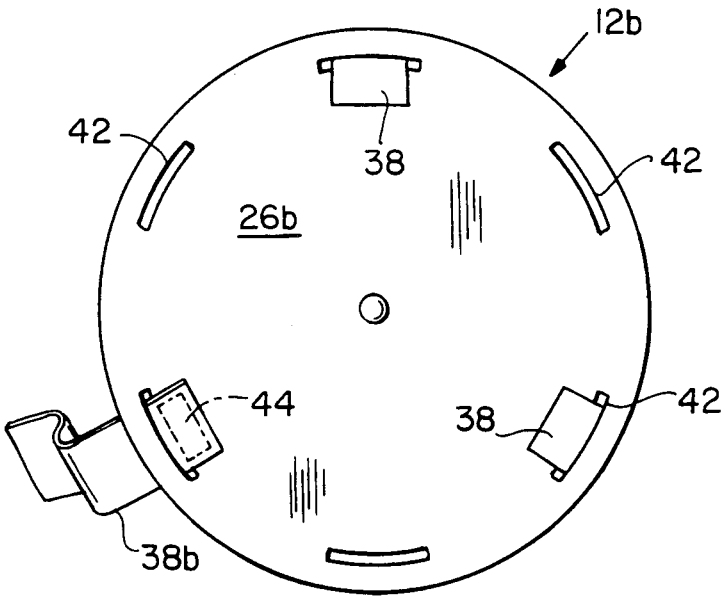
FIG. 3 is a top view of an attachment member having a plurality of circumferential slots.

Stabilizer **12*b*, FIG. 3, may also include circumferential slots 42 for retaining flexible strips 38 along the periphery of attachment member 26*b*. Strip 38*a* is shown removably secured to attachment member 12 by means of hook-and-pile fastener 44 and passing through a slot 42. In a preferred embodiment, the flexible strips 38 are approximately 24 inches in length so that they accomplish the objective of making the disc easier to catch, but are short enough not to drag on the ground when thrown by a child. The strips may have a width chosen to achieve the desired performance. It has been found that about 1 inch width provides stability and visual effect; wider strips create additional drag, slowing the disc flight. As an example of a working embodiment, for a disc of diameter 9.25 inches, having an attachment member of approximately 4.62 inches diameter, there may be three flexible strips about 24 inches long and about 1 inch wide. Although stabilizer 12 is shown having a disc-shaped attachment member 26 and three equally spaced flexible strips 38, this is not a necessary limitation of the invention. For example, attachment member 26 may be irregularly-shaped with a non-symmetrical arrangement of flexible strips 38**. As well, the strips may be attached peripherally or centrally to the attachment member, and may or may not be removable.

In a typical application, flying disc 10 is propelled horizontally with flexible strips 38 suspended below disc 16 and pointing away from the direction of flight. By positioning the flexible strips below the disc, the strips do not contact the rotating disc surface and the spinning action continues unimpeded by such contact friction. Disc 16 spins freely of stabilizer 14 which acts to stabilize the flight of disc 10 much as the flight of a kite is stabilized by a tail. Consequently, disc 10 travels in flatter trajectory and tends to maintain an essentially horizontal attitude even if initially propelled at another angle. Because disc 10 will thus exhibit a more stabilized flight, catching the disc will be easier for an intended recipient.

The flying disc of the present invention may be caught not only by rim 20, as with a conventional flying disc, but also by any of the flexible strips 38. This feature benefits the young or inexperienced user who may lack the requisite coordination for catching by the rim. Additionally, the strips impart less of an impact force to a user's hand than does a flying disc rim.

Multiple strips tend to provide more stability than does one strip alone, but should be kept from intertwining while the disc is in flight. Slots 42 act to minimize such entanglement by separating strips 38 along the periphery of member 26*b*. This separation also serves to provide a unique and more pleasing visual effect when the strips trail behind a flying disc 12.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A stabilized flying disc comprising:

a disc, having a convex upper surface, with a substantially flat central portion, a downwardly-curving rim, and a concave inner surface;

an attachment member, rotatably connected to said disc proximate the center of the concave inner surface; and a plurality of flexible strips secured to said attachment member.

2. The stabilized flying disc of claim 1 in which the attachment member includes a guide means for each flexible strip.

3. The stabilized flying disc of claim 1 in which the attachment member is positioned at or above the disc rim.

4. The stabilized flying disc of claim 1 in which the space, defined by said attachment member and the disc rim, accommodates a user's fingers.

5. The stabilized flying disc of claim 1 in which said attachment member is in the general shape of a flat disc.

6. The stabilized flying disc of claim 5 in which the ratio of disc diameter to attachment member diameter is approximately 2 to 1.

7. The stabilized flying disc of claim 1 in which the ratio of strip length to width is approximately 24 to 1.

8. The stabilized flying disc of claim 1 in which said attachment member is removably connected to said disc.

9. The stabilized flying disc of claim 1 in which said strips are equally spaced on the periphery of said attachment member.

10. The stabilized flying disc of claim 2 in which said guide means comprises a circumferential slot in said attachment member.

11. The stabilized flying disc of claim 1 in which said strips are removably secured to said attachment member.

12. A stabilized flying disc toy comprising:

a disc having a convex upper surface, with a substantially flat central portion, a downwardly-curving rim, and a concave inner surface;

a flat disc-shaped attachment member removably rotatably connected to said disc proximate the center of the concave inner surface; and a plurality of flexible strips secured to and evenly spaced around the periphery of said attachment member.

13. A stabilized flying disc toy comprising:

a disc approximately 9.25 inches in diameter, having a convex upper surface, with a substantially flat central portion, a downwardly-curving rim, and a concave inner surface;

a disc-shaped attachment member approximately 4.62 inches in diameter, rotatably connected to said disc proximate the center of the concave inner surface; and three flexible strips, approximately 24 inches by 1 inch, removably secured to said attachment member.

* * * * *